US008590887B2

(12) United States Patent
Cha et al.

(10) Patent No.: US 8,590,887 B2
(45) Date of Patent: Nov. 26, 2013

(54) AUTOMATIC TELLER MACHINE WITH SHEET ROLLER PORTION WITH DIFFERENT FRICTION FORCES

(75) Inventors: Jin Hwan Cha, Seoul (KR); Dong Sik Lee, Seoul (KR)

(73) Assignee: Nautilus Hyosung Inc., Seoul (KR)

( * ) Notice: Subject to any disclaimer, the term of this patent is extended or adjusted under 35 U.S.C. 154(b) by 0 days.

(21) Appl. No.: 13/519,263

(22) PCT Filed: Dec. 31, 2010

(86) PCT No.: PCT/KR2010/009610

§ 371 (c)(1),
(2), (4) Date: Jun. 26, 2012

(87) PCT Pub. No.: WO2011/081495

PCT Pub. Date: Jul. 7, 2011

(65) Prior Publication Data

US 2012/0286467 A1 Nov. 15, 2012

(30) Foreign Application Priority Data

Dec. 31, 2009 (KR) ..... 10-2009-0136163

(51) Int. Cl.
*B65H 3/06* (2006.01)

(52) U.S. Cl.
CPC ..... *B65H 3/0638* (2013.01)
USPC ..... 271/119; 271/3.14; 271/3.18; 271/264; 271/21

(58) Field of Classification Search
USPC ..... 271/234, 264, 21
See application file for complete search history.

(56) References Cited

U.S. PATENT DOCUMENTS

| | | | | |
|---|---|---|---|---|
| 6,666,448 | B2 * | 12/2003 | Sato et al. | 271/177 |
| 2008/0284085 | A1 * | 11/2008 | Curina et al. | 271/3.14 |
| 2009/0160127 | A1 | 6/2009 | Kong et al. | |
| 2010/0207317 | A1 * | 8/2010 | Iwami et al. | 271/119 |

FOREIGN PATENT DOCUMENTS

| | | | |
|---|---|---|---|
| JP | 58047733 | A * | 3/1983 |
| KR | 20-0392317 | Y1 | 8/2005 |
| KR | 10-2006-0078955 | A | 7/2006 |
| KR | 10-2009-0072666 | A * | 7/2009 |

OTHER PUBLICATIONS

PCT Internationa Search Repport and Written Opinion, PCT/KR2010/009610, Sep. 27, 2011, 11 Pages.

* cited by examiner

*Primary Examiner* — Gerald McClain
(74) *Attorney, Agent, or Firm* — Fenwick & West LLP

(57) ABSTRACT

An automatic teller machine (ATM) may include a medium transfer portion to transfer paper mediums from a paper medium storage portion storing the paper mediums, a carrier position adjustment portion rotatably mounted at a rear end of the carrier transfer portion, to which a medium carrier stacking and carrying the paper mediums transferred along the medium transfer portion is rotatably mounted, and a sheet roller portion rotatably mounted between the medium carrier and the carrier position adjustment portion to transfer the paper mediums on the medium transfer portion into the medium carrier by a rotational operation and to align the paper mediums stored in the medium carrier, wherein the sheet roller portion contacts the paper medium such that a greater frictional force is generated at a middle area than an outer area when transferring the paper mediums on the medium transfer portion into the medium carrier or when aligning the paper mediums stored in the medium carrier.

5 Claims, 5 Drawing Sheets

AUTOMATIC TELLER MACHINE WITH SHEET ROLLER PORTION WITH DIFFERENT FRICTION FORCES

TECHNICAL FIELD

The present invention relates to an automatic teller machine (ATM), and more particularly, to an ATM capable of smoothly transferring a sheet of paper medium from a medium transfer portion to a medium carrier and correctly aligning paper mediums, which are temporarily stacked on the medium carrier, by rotation of a sheet roller portion although the paper mediums are skewed when introduced to a stacking space of the medium carrier.

BACKGROUND ART

Generally, an automatic teller machine (ATM) refers to an automated apparatus providing fundamental monetary services, such as payment and withdrawal of cash and check, using a card or a bankbook regardless of time and places without a bank teller. Recently, use of the ATM is not limited to banking facilities such as banks but expanded to convenience stores, department stores, and other public places.

The ATM may be classified into a cash dispenser, a cash receiver, and a cash dispenser and receiver.

In these days, the ATM is used for not only payment and withdrawal of cash but also payment and withdrawal of check, bankbook arrangement, fee payment by giro, ticketing, and the like.

A structure of an ATM used as a cash dispenser will be briefly described. The ATM includes a medium storage portion to store paper mediums such as cash, a medium transfer portion to transfer the paper mediums supplied from the medium storage portion, a medium conveying portion to convey the paper mediums received from the medium transfer portion to a dispenser portion, and a conveying portion position adjustment portion to adjust a position of the medium conveying portion, for example to the dispenser portion.

By the foregoing structure, the paper mediums in the medium storage portion are passed through the medium transfer portion and temporarily stacked in the medium conveying portion. Next, as the medium conveying portion is moved by operation of the conveying portion position adjustment portion, the paper mediums may be supplied to the dispenser portion.

However, the foregoing conventional ATM is not equipped with a dedicated structure for removing a skew in case that the paper mediums on the medium transfer portion are skewed when stacked on the medium conveying portion. Therefore, the paper mediums may be partially skewed while being conveyed on the medium conveying portion. Accordingly, when the paper mediums are dispensed through the dispenser portion, one ends of the paper mediums, directed to a customer, may not be aligned.

Accordingly, there is a need for an ATM in an improved structure to correctly align the paper mediums when the paper mediums are temporarily stacked on the medium conveying portion.

DISCLOSURE OF INVENTION

Technical Goals

An aspect of the present invention provides an automatic teller machine (ATM) capable of correctly aligning paper mediums, which are temporarily stacked on a medium carrier, by rotation of a sheet roller portion although the paper mediums are skewed when introduced into a stacking space of the medium carrier, and accordingly supplying a dispenser portion with the correctly aligned paper mediums.

Another aspect of the present invention provides an ATM capable of smoothly transferring the paper mediums on a medium transfer portion to the stacking space of the medium carrier through rotation of the sheet roller portion.

Technical Solutions

According to an aspect of the present invention, there is provided an automatic teller machine (ATM) including a medium transfer portion to transfer paper mediums, a carrier position adjustment portion rotatably mounted at a rear end of the carrier transfer portion, a medium carrier withdrawbly mounted in the carrier position adjustment portion to carry the paper mediums transferred by the medium transfer portion and stacked, and a sheet roller portion rotatably mounted between the medium carrier and the carrier position adjustment portion to transfer the paper mediums on the medium transfer portion into the medium carrier by a rotational operation and to align the paper mediums stored in the medium carrier. The sheet roller portion may contact the paper medium such that a greater frictional force is generated at a middle area than an outer area when transferring the paper mediums on the medium transfer portion into the medium carrier or when aligning the paper mediums stored in the medium carrier.

According to the structure, paper mediums, which are temporarily stacked on a medium carrier, may be correctly aligned by rotation of a sheet roller portion although the paper mediums are skewed when introduced into a stacking space of the medium carrier. Accordingly, a dispenser portion may be supplied with the correctly aligned paper mediums.

The sheet roller portion may include a middle sheet roller of which at least a part is brought into contact with a middle part of the paper mediums stored in the medium carrier, and an outer sheet roller of which at least a part is brought into contact with an outer part of the paper mediums stored in the medium carrier, by a smaller contact area than a contact area of the middle sheet roller.

The middle sheet roller may include a pair of middle sheet rollers contacting the middle part of the paper mediums, the outer sheet roller comprises a pair of outer sheet rollers contacting opposite side parts of the paper mediums, and the middle sheet roller is made of a material generating a greater frictional force than a material of the outer sheet roller. Therefore, a relatively greater supporting force may be generated at the middle part than the outer part of the paper mediums, thereby preventing a skew of the paper mediums being stacked.

The middle sheet roller may be made of rubber and the outer sheet roller may be made of plastic. Therefore, a frictional force between the middle sheet roller and the paper mediums may be greater than a frictional force between the outer sheet roller and the paper mediums.

Each of the middle sheet roller and the outer sheet roller may include a roller body connected to a rotational axis and rotated by rotation of the rotational axis, and a plurality of sheet members extending in a radial direction from an outer surface of the roller body, being arranged at uniform intervals along a circumference of the roller body, to be brought into actual contact with the paper mediums, wherein a length of a sheet member of the middle sheet roller is greater than a length of a sheet member of the outer sheet roller.

The sheet roller portion may include a middle sheet roller of which at least a part is brought into contact with a middle part of the paper mediums stored in the medium carrier, and an outer sheet roller of which at least a part is brought into contact with outer parts of the paper mediums stored in the medium carrier, being made of a material generating a smaller frictional force than a material of the middle sheet roller.

A plurality of support portions are disposed at an outer part of the medium carrier to support part of the paper mediums being in the medium carrier so that the paper mediums are aligned, and the plurality of support portions may be disposed in positions separated toward opposite sides with respect to a middle of an outer side surface the paper mediums.

Each of the plurality of support portions may include a support body extending in a width direction of a transfer direction of the paper mediums, and a plurality of supporting ribs protruding from an outer surface of the support body to be brought into contact with part of the outer side surface of the paper mediums stored in the medium carrier. Accordingly, although the paper mediums are skewed when introduced in the medium carrier, the paper mediums may be correctly aligned.

The sheet roller portion may include a middle sheet roller of which at least a part is brought into contact with the paper mediums stored in the medium carrier, and an outer sheet roller of which at least a part is brought into contact with outer parts of the paper mediums stored in the medium carrier, the outer sheet roller having a smaller contact area than a contact area of the middle sheet roller or being made of a material generating a smaller frictional force than a material of the middle sheet roller, and the plurality of support portions may be each disposed between the middle sheet roller and the outer sheet roller.

According to another aspect of the present invention, there is provided an ATM including a medium transfer portion to transfer paper mediums, a carrier position adjustment portion rotatably mounted at a rear end of the carrier transfer portion, a medium carrier withdrawbly mounted in the carrier position adjustment portion to carry the paper mediums transferred by the medium transfer portion and stacked, a plurality of support portions disposed at an outer part of the medium carrier to contact one side of the paper mediums stacked in the medium carrier, and a sheet roller portion rotatably mounted between the medium carrier and the carrier position adjustment portion to transfer the paper mediums on the medium transfer portion into the medium carrier by a rotational operation and to align the paper mediums stored in the medium carrier. The sheet roller portion may contact the paper medium such that a greater frictional force is generated at a middle area than an outer area when transferring the paper mediums on the medium transfer portion into the medium carrier or when aligning the paper mediums stored in the medium carrier.

The sheet roller portion may include a middle sheet roller of which at least a part is brought into contact with the paper mediums stored in the medium carrier, and an outer sheet roller of which at least a part is brought into contact with outer parts of the paper mediums stored in the medium carrier, the outer sheet roller having a smaller contact area than a contact area of the middle sheet roller or being made of a material generating a smaller frictional force than a material of the middle sheet roller. The plurality of support portions may be disposed between the middle sheet roller and the outer sheet roller, in positions separated toward opposite sides with respect to a middle of an outer side surface the paper mediums.

Effects of the Invention

According to an embodiment of the present invention, an automatic teller machine (ATM) may correctly align paper mediums, which are temporarily stacked on a medium carrier, by rotation of a sheet roller portion although the paper mediums are skewed when introduced into a stacking space of the medium carrier, and accordingly supply a dispenser portion with the correctly aligned paper mediums.

In addition, according to an embodiment of the present invention, the ATM may smoothly transfer the paper mediums on a medium transfer portion to the stacking space of the medium carrier through rotation of the sheet roller portion.

BEST MODE FOR CARRYING OUT THE INVENTION

Hereinafter, structure and application of embodiments of the present invention will be described in detail with reference to the accompanying drawings. The following description illustrates one of various aspects of the present invention and constitutes part of a detailed description about the present invention.

However, in explaining the embodiments of the present invention, generally known functions and structures will not be explained in detail for conciseness.

Figure 1:
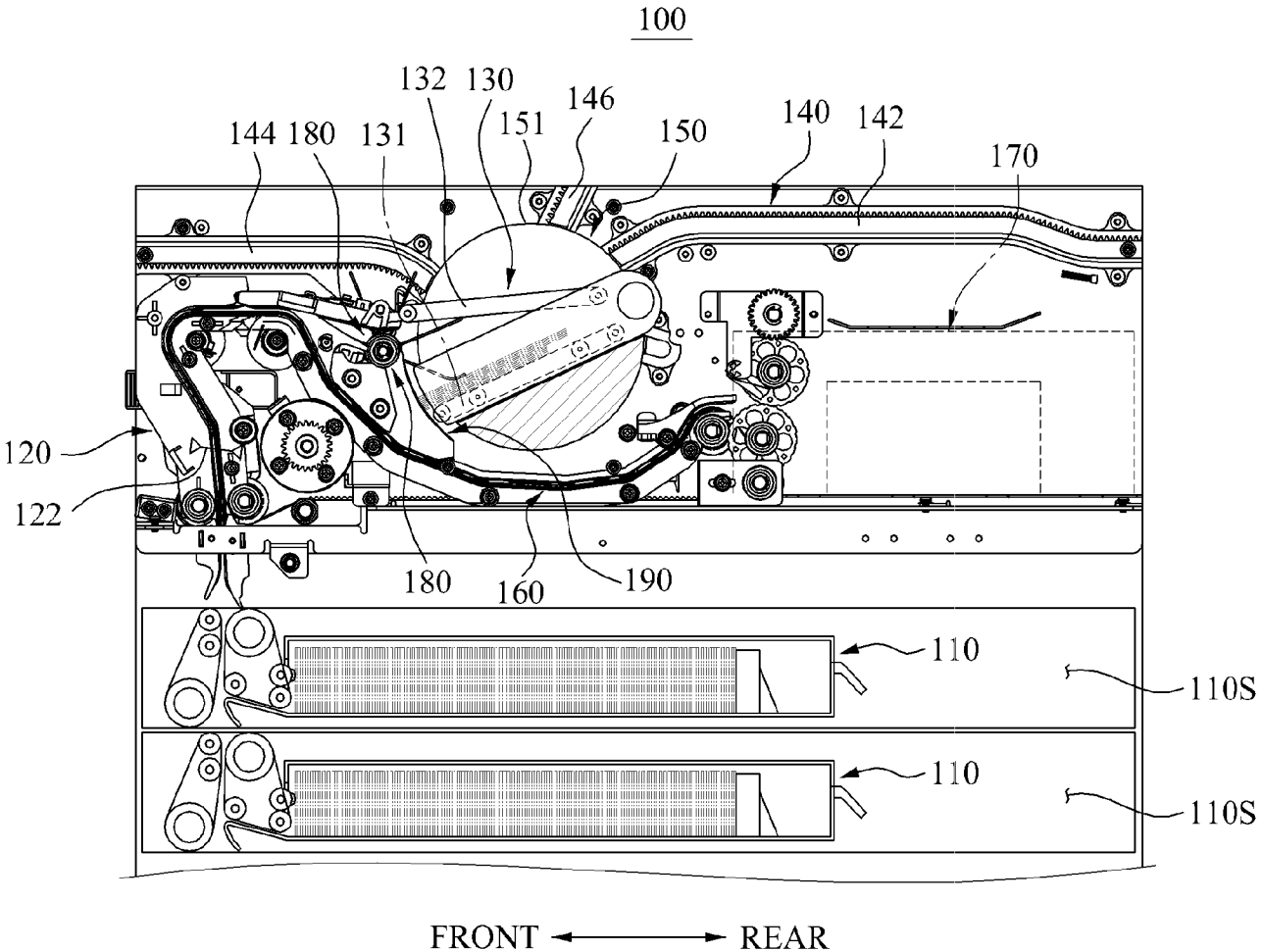
FIG. 1 is a view schematically illustrating a structure of an automatic teller machine (ATM) according to an embodiment of the present invention.
Figure 2:
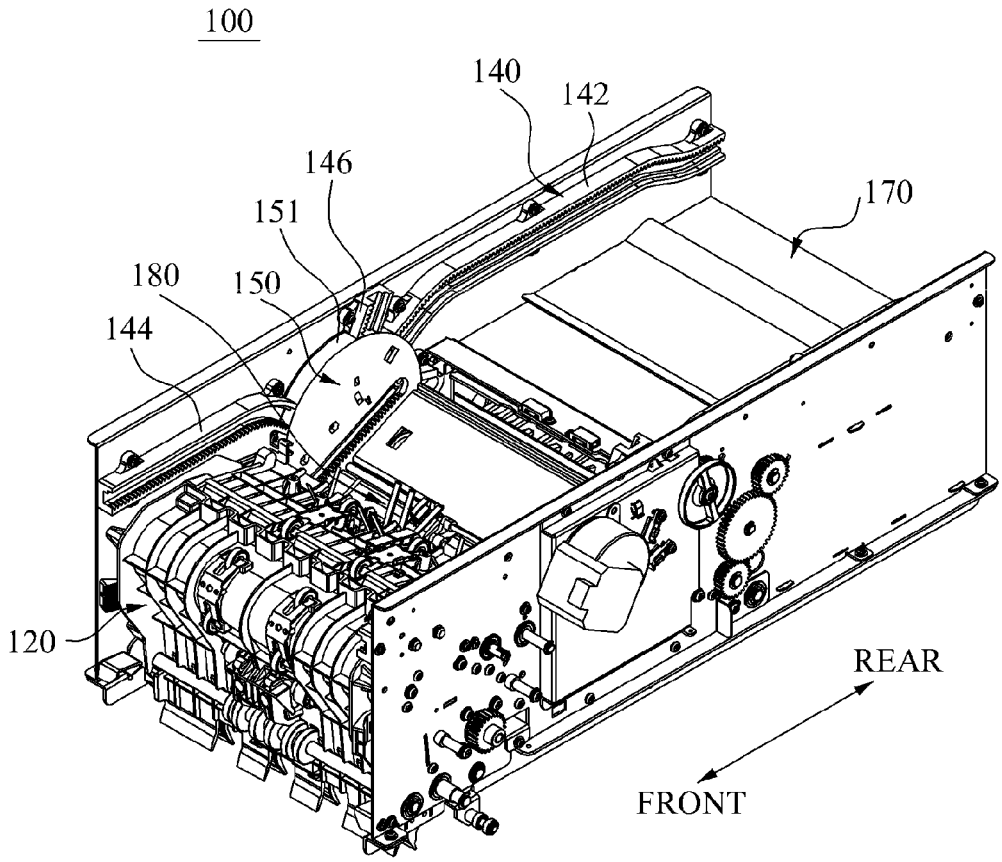
FIG. 2 is a perspective view illustrating a partial structure of an upper portion of of the ATM of FIG. 1.
Figure 3:
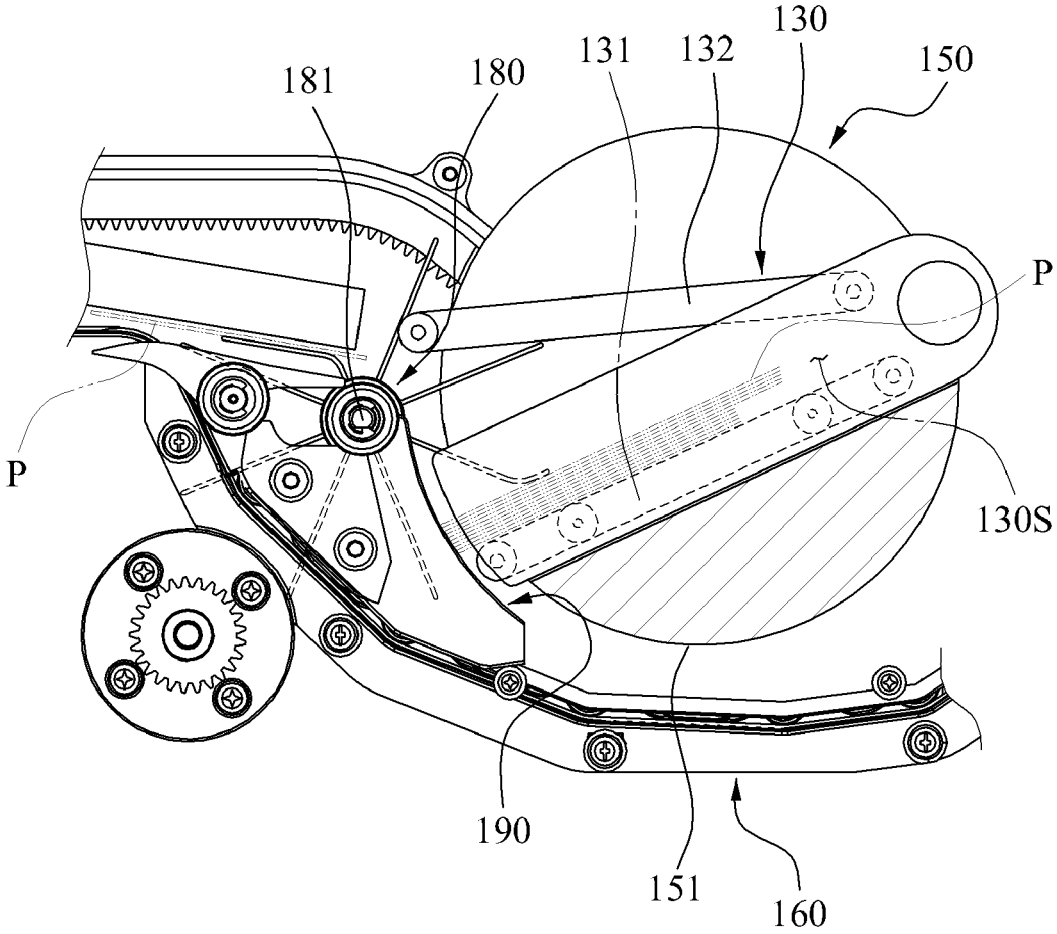
FIG. 3 is a partially enlarged view of FIG. 1.
Figure 4:
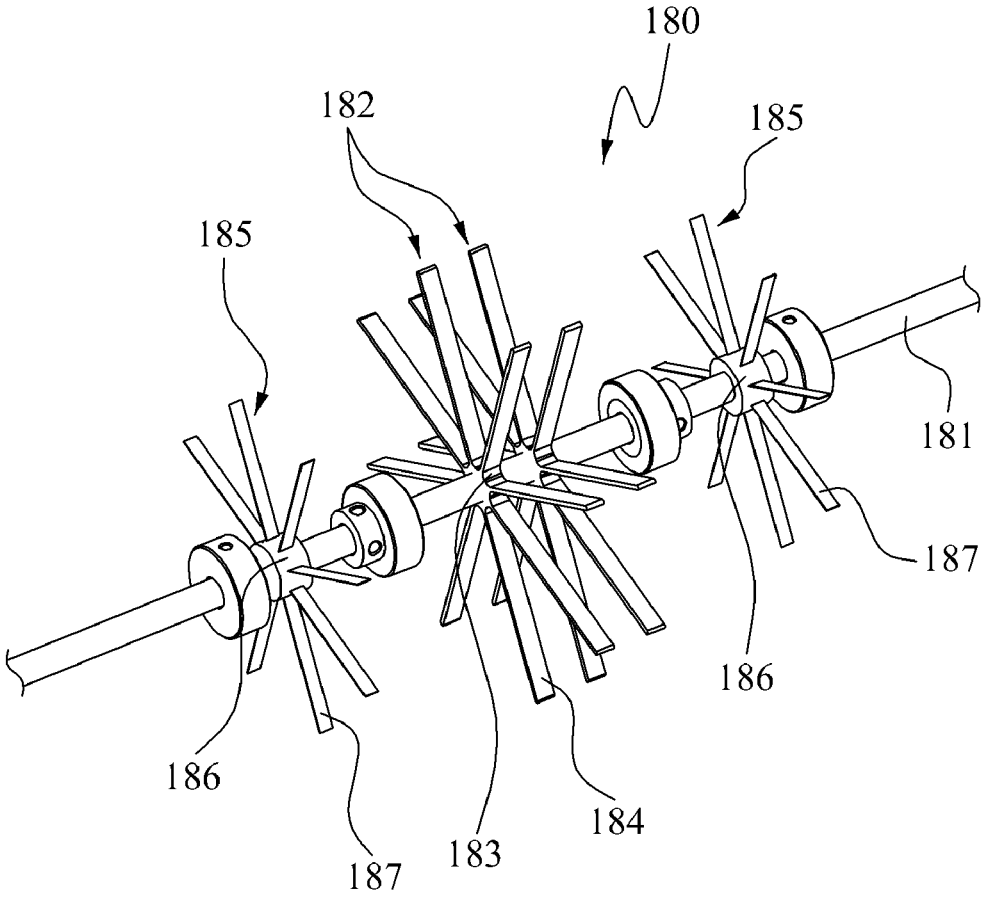
FIG. 4 is a perspective view of a sheet roller portion shown in FIG. 3.
Figure 5:
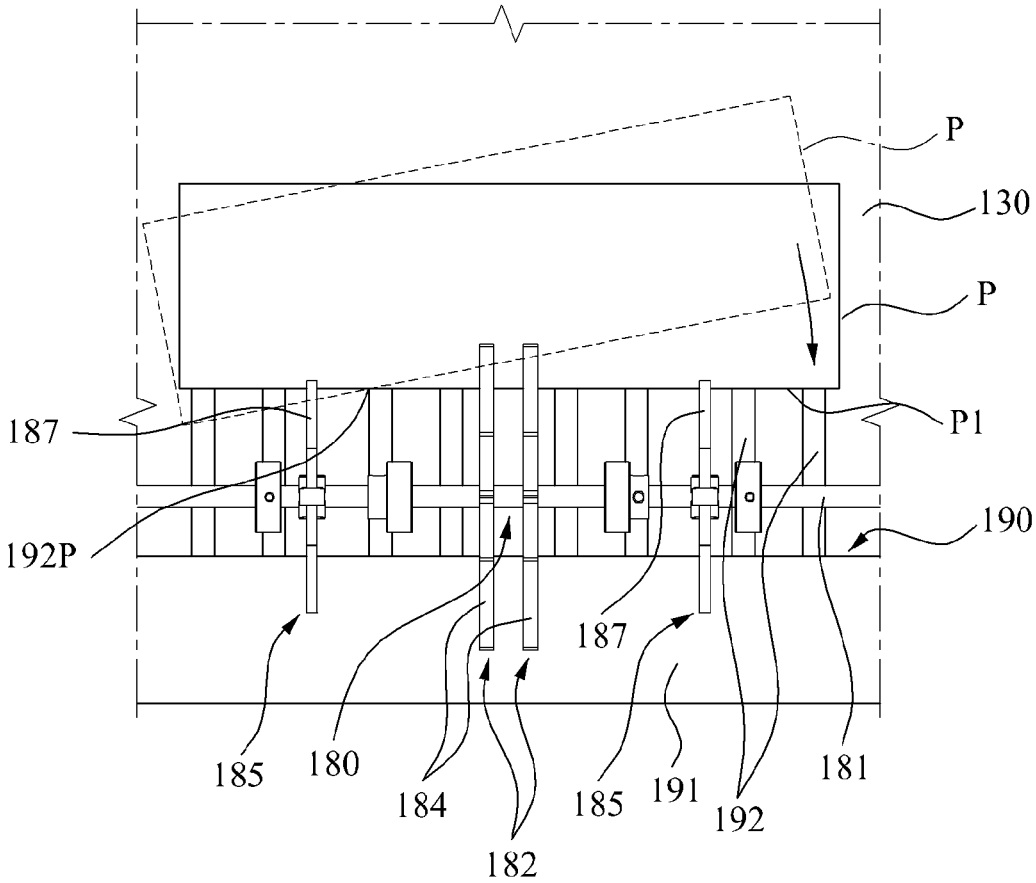
FIG. 5 is a view illustrating operation of the sheet roller portion that aligns paper mediums in a skewed state in a medium carrier shown in FIG. 3.

FIG. 1 is a view schematically illustrating a structure of an automatic teller machine (ATM) according to an embodiment of the present invention. FIG. 2 is a perspective view illustrating a partial structure of an upper portion of of the ATM of FIG. 1. FIG. 3 is a partially enlarged view of FIG. 1. FIG. 4 is a perspective view of a sheet roller portion shown in FIG. 3. FIG. 5 is a view illustrating operation of the sheet roller portion aligning paper mediums in a skewed state in a medium carrier shown in FIG. 3.

Referring to FIGS. 1 to 3, the ATM 100 may include a medium storage portion 110 to store paper mediums P, a medium transfer portion 120 to transfer the paper mediums P supplied from the medium storage portion 110, a medium carrier 130 to carry the paper mediums P transferred by the medium transfer portion 120 to a dispenser portion (not shown), a carrier transfer portion 140 which forms a movement path for the medium carrier 130 to move to the dispenser portion, a carrier position adjustment portion 150 to adjust a position of the medium carrier 130, the rejected medium transfer portion 160 connected to a rear end of the medium transfer portion 120 to transfer a paper medium P detected to be abnormal during transfer along the medium transfer portion 120 and determined to be rejected, and the collected medium storage portion 170 disposed within a movement range of the medium carrier 130 to collect a paper medium P not received by the dispenser portion but refracted or collect the rejected paper medium P transferred along the rejected medium transfer portion 170.

The respective parts will be described. The medium storage portion 110 may store the paper mediums P. The paper mediums P may include banknotes, checks, merchandise coupons, tickets, and the like. The medium storage portion 110 may be provided in the form of a cassette removably connected to a plurality of receiving spaces 110S arranged in a height direction in the ATM 100. Therefore, the paper mediums P may be stored in the medium storage portion 110. As the medium storage portion 110 is selectively connected to an inside of the ATM 100, the paper mediums P may be supplied to or withdrawn from the inside of the ATM 100.

The medium transfer portion 120 is adapted to transfer the paper mediums P stored in the medium storage portion 110 sheet by sheet. As shown in FIGS. 1 and 2, the medium transfer portion 120 may be disposed between the medium storage portion 110 and the carrier position adjustment portion 150, to feed the paper mediums P being in the medium carrier 130 disposed at the carrier position adjustment portion 150. The medium transfer portion 120 may include a plurality of rollers and belts for transferring the paper mediums P. That is, as the rollers are rotated, the belts are circulated, thereby transferring the paper mediums P.

In addition, the medium transfer portion 120 may include a medium sensor 122 to detect whether the paper medium P being transferred from the medium storage portion 110 includes a single sheet. That is, the medium sensor 122 may detect a thickness change of the paper mediums P being transferred by the medium transfer portion 120, thereby determining whether the paper medium P includes a single sheet.

In addition, a sheet roller portion 180 may be provided at an exit of the medium transfer portion 120 to feed the paper mediums P transferred by the medium transfer portion 120 sheet by sheet into the medium carrier 130 and, in addition, to align the paper mediums P temporarily stacked in the medium carrier 130. This will be described later in further details.

The medium carrier 130 is adapted to load and carry at least one sheet of the paper mediums P transferred by the medium transfer portion 120. A medium loaded in the medium carrier 130 may include a single sheet or plural sheets of the paper mediums P.

The medium carrier 130 may include a first carrier portion 131 and a second carrier portion 132 capable of moving toward or away from the first carrier portion 131. The first carrier portion 131 and the second carrier portion 132 are provided in a panel form. Since the second carrier portion 132 may approach the first carrier portion 131, the paper mediums P may be fixed within the first carrier portion 131 and the second carrier portion 132.

The paper mediums P transferred from the medium transfer portion 120 may be stacked in the medium carrier 130. As shown in FIG. 3, the paper mediums P are stacked in such a manner than one side of the paper mediums P, directed to an outer side of the medium carrier 130, are aligned. The alignment of the paper mediums P may be achieved by the sheet roller portion 180, which will be described later.

The medium carrier 130 may be transferred to the dispenser portion along the carrier transfer portion 140. The carrier transfer portion 140 may be formed between the dispenser portion and the carrier position adjustment portion 150 that will be described later. The carrier transfer portion 140 may include a rail structure to enable transfer of an entire part of the medium carrier 130.

Hereinafter, the ATM 100 according to the present embodiment will be described to include a plurality of the dispenser portions and accordingly include a plurality of the carrier transfer portions 140. For example, the dispenser portions are disposed at a front part, a rear part, and an upper part of the ATM 100. Accordingly, the carrier transfer portions 140 may include a front carrier transfer portion 142 connected to the dispenser portion provided at the front part, a rear carrier transfer portion 144 connected to the dispenser portion provided at the rear part, and an upper carrier transfer portion 146 connected to the dispenser portion provided at the upper part.

The carrier position adjustment 150 may change the position of the medium carrier 130 as shown in FIG. 1. That is, the carrier position adjustment 150 may include a rotor 151 to rotate the medium carrier 130, and a rotor driving portion (not shown) to drive the rotor 151. With the foregoing structure, the carrier position adjustment portion 150 may rotate the medium carrier 130, thereby changing the position of the medium carrier 130 so that an open portion of the medium carrier 130 is directed to any one of an exit of the medium transfer portion 120, an entrance of the front carrier transfer portion 142, an entrance of the rear carrier transfer portion 144, an entrance of the upper carrier transfer portion 146, and an entrance of the collected medium storage portion 170 that will be described later.

Furthermore, the carrier position adjustment portion 150 may transfer the medium carrier 130 along the carrier transfer portions 140 as well as changing the position of the medium carrier 130 in a rotating manner. Therefore, the medium carrier 130 may be transferred to the respective dispenser portions and accordingly supply the paper mediums P held in the medium carrier 130 to the dispenser portions.

The collected medium storage portion 170 is adapted to collect paper mediums P dispensed by the dispenser portions but not received, and therefore retracted, or paper mediums P determined to be rejected during transfer along the medium transfer portion 120. In the same manner as the medium storage portion 110, the collected medium storage portion 170 may be a cassette type to be easily connected to and detached from the ATM 100.

The rejected medium transfer portion 160 may be connected to the medium transfer portion 120 with one end and connected to the entrance of the collected medium storage portion 170 with a rear end, as shown in FIG. 1. Accordingly, the rejected paper mediums P transferred from the medium transfer portion 120 may be passed through the rejected medium transfer portion 160 and stored in the collected medium storage portion 170.

Referring to FIGS. 1 and 3, the ATM 100 according to the embodiment of the present invention may include a sheet roller portion 180 to transfer the medium carrier 130 so that the paper mediums P transferred along a transfer path of the medium transfer portion 120 are smoothly transferred sheet by sheet to a stacking space 130S of the medium carrier 130, and a support portion 190 disposed in an area facing the open portion of the medium carrier 130 during stacking of the paper mediums P from the medium transfer portion 120 to the medium carrier 130 so as to support one side surface P1 of the paper mediums P, the one side surface P1 directed outward with reference to FIG. 5.

The structure of the sheet roller portion 180 will be described first. As shown in FIG. 4, the sheet roller portion 180 may include a rotational axis 181 rotatable in one direction, a pair of middle sheet rollers 182 connected to a middle part of the rotational axis 181, and a pair of outer sheet rollers 185 connected to opposite sides of the rotational axis 181.

The middle sheet rollers 182 and the outer sheet rollers 182 may be in different sizes and made of different materials, but may be in similar shapes. As shown in FIGS. 4 and 5, the middle sheet rollers 182 and the outer sheet rollers 182 may respectively include roller bodies 183 and 186 connected to the rotational axis 181, and pluralities of sheet members 184 and 187 extending in a radial direction from outer surfaces of the roller bodies 183 and 186.

Therefore, as the rotational axis 181 rotates, the middle sheet rollers 182 and the outer sheet rollers 185 may be rotated substantially simultaneously, thereby transferring a sheet of the paper mediums P being on the medium transfer portion 120 to the stacking space 130S of the medium carrier 130.

However, as aforementioned, the sheet members 184 of the middle sheet rollers 182 and the sheet members 187 of the outer sheet rollers 185 performing transfer of the paper mediums P by actually contacting the paper mediums P may be formed in different lengths and different materials.

That is, the sheet members 184 of the middle sheet rollers 182 may have a length greater than a length of the sheet members 187 of the outer sheet rollers 185, and furthermore may be made of a material generating a greater frictional force than a material of the outer sheet rollers 185. In addition, the middle sheet rollers 182 may have a greater width to increase a contact area.

In addition, the sheet members 184 of the middle sheet rollers 182 may be made of rubber generating a great frictional force whereas the sheet members 187 of the outer sheet rollers 185 are made of plastic generating a relatively smaller frictional force than rubber. However, not limited thereto, the sheet members 184 of the middle sheet rollers 182 and the sheet members 187 of the outer sheet rollers 185 may be made of other materials.

According to the structural features, when the sheet roller portion 180 transfers the paper mediums P on the medium transfer portion 120 to the medium carrier 130, a relatively greater supporting force may be generated at a middle part of the paper mediums P than outer parts of the paper mediums P. Therefore, occurrence of a skew may be prevented during stacking of the paper mediums P. Here, the outer parts of the paper mediums P may also be supported by a supporting force of the outer sheet rollers 185. Therefore, the paper mediums P on the medium transfer portion 120 may be smoothly transferred to the stacking space 130S of the medium carrier 130.

The paper mediums P transferred to the medium carrier 130 by the sheet roller portion 180 may collide with an inner part of the medium carrier 130 and fall, thereby being orderly stacked in the stacking space 130S of the medium carrier as shown in FIG. 3. Here, the paper mediums P need to be aligned such that the one side surface P1 directed outward with respect to the medium carrier 130 becomes one surface. For this purpose, the present embodiment includes the support portion 190 to support the outer surface P1 of the paper mediums P.

As shown in FIGS. 3 and 5, the support portion 190 may be configured in such a manner that the sheet roller portion 180 is partially interposed between the support portion 190 at a lower part of the sheet roller portion 180. One side of the support portion 190 may be shaped to correspond to an outer shape of the rotor 151 of the carrier position adjustment portion 150 that rotates the medium carrier 130. That is, an outer part of the support portion 190 is curved corresponding to a circular outer surface of the rotor 151.

To be more specific, as schematically shown in FIG. 5, the support portion 190 may include a support body 191 extending in a width direction of a transfer direction of the paper mediums P, and a plurality of support ribs 192 protruding from an outer surface of the support body 191 toward the rotor 151 to be brought into contact with part of the outer side surface P1 of the paper mediums P stacked in the medium carrier 130.

The plurality of support ribs 192 are arranged at intervals along a width of the support body 191. The middle sheet rollers 182 and the outer sheet rollers 185 of the sheet roller portion 180 are partially inserted and rotated in the intervals, thereby performing transfer and alignment of the paper mediums P.

The plurality of support ribs 192 align the paper mediums P stacked in the medium carrier 130. That is, the paper mediums P transferred from the medium transfer portion 120 to the stacking space 130S of the medium carrier 130 collide with an inner wall of the medium carrier 130 and fall, thereby being supported by the plurality of support ribs 192 with one surface. Accordingly, plural sheets of the paper mediums P are orderly aligned along the support ribs 192.

Here, the sheet roller portion 180 may align the paper mediums P by pulling the paper mediums P on the medium carrier 130 downward by a rotational operation. That is, any one of the sheet members 184 and 187 of the sheet roller portion 180 performs alignment of the paper mediums P on the medium carrier 130 whereas another adjacent one of the sheet members 184 and 187 transfers the paper mediums P being on the medium transfer portion 120 to the medium carrier 130 sheet by sheet.

However, whereas most of the paper mediums P is stacked in an aligned state on the medium carrier 130, the paper mediums P transferred from the medium transfer portion 120 to the medium carrier 130 in a skewed state may be still skewed even on the plurality of support ribs 192 as shown in FIG. 5.

In this case, since the middle sheet rollers 182 of the sheet roller portion 180 pull the middle part of the paper mediums P downward by a strong frictional force while maintaining a relatively large contact area compared to the outer sheet rollers 185, the paper mediums P in the skewed state may be rotated about an intersection point 192P with respect to a contacting support rib 192 among the plurality of support ribs 192. As a result, the paper mediums P may be aligned.

That is, although the paper mediums P on the medium carrier 130 are skewed, the skewed paper mediums P may be correctly aligned through the rotational operation of the sheet roller portion 180. Therefore, the medium carrier 130 may supply the paper mediums P in the aligned state to the dispenser portion.

Hereinafter, a process of transferring the paper mediums P in the above-structured ATM 100 will be described.

First, the paper mediums P are supplied sheet by sheet from the medium storage portion 110 to the medium transfer portion 120, and the medium transfer portion 120 transfers the paper mediums P to the medium carrier 130. In this instance, the medium sensor 122 may detect whether the paper mediums P are in a normal or abnormal state. The paper medium P detected to be abnormal and determined to be rejected may be transferred to the collected medium storage portion 170 along the rejected medium transfer portion 160.

Here, when the paper mediums P are transferred from the medium transfer portion 120 to the medium carrier 130, the sheet roller portion 180 disposed between the medium transfer portion 120 and the medium carrier 130 may enable transfer of the paper mediums P sheet by sheet. As well as transferring the paper mediums P to the medium carrier 130, the sheet roller portion 180 may also align the paper mediums P introduced in the stacking space 130S of the medium carrier 130 by bringing the paper mediums P into contact with the plurality of support ribs 192.

Next, the first carrier portion 131 and the second carrier portion 132 of the medium carrier 130 may approach each other, thereby holding the paper mediums P. The carrier position adjustment portion 150 may transfer the medium carrier 130 to the dispenser portion. Therefore, a shutter of the dispenser portion is opened and closed, and the aligned paper mediums P are dispensed through the opened and closed part so that a customer may receive the paper mediums P.

Thus, according to the embodiment of the present invention, although the paper mediums P are introduced into the stacking space 130S of the medium carrier 130 in a skewed state, the sheet roller portion 180 may correctly align the paper mediums P temporarily stacked on the medium carrier 130, by the rotational operation. Accordingly, the paper mediums P may be dispensed through the dispenser portion in the correctly aligned state.

In addition, since the sheet roller portion 180 smoothly transfers the paper mediums P on the medium transfer portion 120 to the stacking space 130S of the medium carrier 130, by the rotational operation, a jam of the paper mediums P during transfer may be prevented.

In the aforementioned embodiment, the sheet roller portion includes a pair of middle sheet rollers and a pair of outer sheet rollers. However, not limited thereto, another number of the sheet rollers may be provided symmetrically to each other.

Although a few embodiments of the present invention have been shown and described, the present invention is not limited to the described embodiments. Instead, it would be appreciated by those skilled in the art that changes may be made to these embodiments without departing from the principles and spirit of the invention, the scope of which is defined by the claims and their equivalents.

The invention claimed is:

1. An automatic teller machine (ATM) comprising:

a medium transfer portion to transfer paper media;

a carrier position adjustment portion rotatably mounted at a rear end of the medium transfer portion and comprising:

a medium carrier formed with a stacking space and comprising:

a first carrier portion, and a second carrier portion, the first carrier portion and second carrier portion approach each other;

a medium carrier mounted in the carrier position adjustment portion to receive and stack the paper media, the paper media colliding with an inner part of the medium carrier and falling to be orderly stacked in the stacking space;

a sheet roller portion mounted between the medium carrier and the carrier position adjustment portion to rotate about a rotational axis to transfer each of the paper media on the medium transfer portion into the medium carrier by rotation of the sheet roller portion, the sheet roller portion exerting greater friction force on a middle area of each of the paper media than an outer area of each of the paper media when placing each of the paper media in the medium carrier, the sheet roller portion comprising:

a middle sheet roller of which at least a part is brought into contact with a middle part of the paper media over a first contact area when placing the paper media in the medium carrier, and an outer sheet roller of which at least a part is brought into contact with an outer part of the paper media over a second contact area smaller than the first contact area;

wherein each of the middle sheet roller and the outer sheet roller comprises:

a roller body connected to a rotational axis and rotated by rotation of the rotational axis, a plurality of sheet members extending in a radial direction from an outer surface of the roller body, being arranged at uniform intervals along a circumference of the roller body, to be brought into actual contact with the paper media, wherein a length of a sheet member of the middle sheet roller is greater than a length of a sheet member of the outer sheet roller; and a support portion comprising:

a support body, and a plurality of support ribs extending from the support body, at least one of the plurality of support ribs coming into contact with a part of an edge of each of the paper media before other support ribs and operating as an intersection point about which each of the paper media is rotated for alignment in the medium carrier so that the at least one of the plurality of support ribs and the other support ribs support the edge of the paper medium when placing each of the paper media in the medium carrier.

2. The ATM of claim 1, wherein the middle sheet roller comprises a pair of middle sheet rollers contacting the middle part of the paper media, the outer sheet roller comprises a pair of outer sheet rollers contacting opposite side parts of the paper media, and the middle sheet roller is made of a material generating a greater frictional force than a material of the outer sheet roller.

3. The ATM of claim 2, wherein the middle sheet roller is made of rubber and the outer sheet roller is made of plastic.

4. The ATM of claim 1, wherein the sheet roller portion comprises:

a middle sheet roller of which at least a part is brought into contact with a middle part of each of the paper media stored in the medium carrier; and an outer sheet roller of which at least a part is brought into contact with outer parts of each of paper media stored in the medium carrier, being made of a material generating a smaller frictional force than a material of the middle sheet roller.

5. The ATM of claim 1, wherein the sheet roller portion comprises a middle sheet roller of which at least a part is brought into contact with the paper media stored in the medium carrier, and an outer sheet roller of which at least a part is brought into contact with outer parts of the paper media stored in the medium carrier, the outer sheet roller having a smaller contact area than a contact area of the middle sheet roller or made of a material generating a smaller frictional force than a material of the middle sheet.

* * * * *